US007608174B1

(12) United States Patent
Hachman et al.

(10) Patent No.: US 7,608,174 B1
(45) Date of Patent: Oct. 27, 2009

(54) APPARATUS AND METHOD FOR ELECTROFORMING HIGH ASPECT RATIO MICRO-PARTS

(75) Inventors: John T. Hachman, Stockton, CA (US); Matthew W. Losey, Rancho Cucamonga, CA (US); Dorrance E. McLean, Manteca, CA (US)

(73) Assignee: Sandia Corporation, Livermore, CA (US)

( * ) Notice: Subject to any disclaimer, the term of this patent is extended or adjusted under 35 U.S.C. 154(b) by 560 days.

(21) Appl. No.: 11/599,766

(22) Filed: Nov. 14, 2006

Related U.S. Application Data

(63) Continuation-in-part of application No. 11/112,927, filed on Apr. 22, 2005.

(51) Int. Cl.
*B23H 7/26* (2006.01)

(52) U.S. Cl. ..... 204/297.01; 204/297.03; 205/67

(58) Field of Classification Search ..... 204/285, 204/286.1, 297.01, 297.03; 205/67
See application file for complete search history.

(56) References Cited

U.S. PATENT DOCUMENTS

| | | | | |
|---|---|---|---|---|
| 2,938,850 | A | 5/1960 | Nali | 204/297 |
| 3,481,858 | A | 12/1969 | Fromson | 204/297 |
| 4,421,627 | A | 12/1983 | LeBaron | 204/297 W |
| 4,696,729 | A | 9/1987 | Santini | 204/224 R |
| 5,135,636 | A | 8/1992 | Yee et al. | 205/96 |
| 5,227,041 | A | 7/1993 | Brogden et al. | 204/297 R |
| 5,228,967 | A | 7/1993 | Crites et al. | 204/228 |
| 5,312,532 | A | 5/1994 | Andricacos et al. | 204/231 |
| 5,405,518 | A | 4/1995 | Hsieh et al. | 204/297 R |
| 6,156,167 | A | 12/2000 | Patton et al. | 204/270 |
| 6,221,437 | B1 | 4/2001 | Reynolds | 427/430.1 |
| 6,248,222 | B1 | 6/2001 | Wang | 204/297.09 |
| 6,517,665 | B1 | 2/2003 | Boehme et al. | 156/345.11 |
| 6,527,925 | B1 | 3/2003 | Batz, Jr. et al. | 204/297.01 |
| 6,589,401 | B1 | 7/2003 | Patton et al. | 204/212 |
| 6,802,950 | B2 | 10/2004 | Hachman, Jr. et al. | 205/82 |
| 6,902,827 | B2 | 6/2005 | Kelly et al. | 428/635 |
| 7,055,535 | B2 | 6/2006 | Kunisawa et al. | 134/157 |
| 7,067,816 | B2 | 6/2006 | Dorenbos et al. | 250/370.11 |

*Primary Examiner*—Nam X Nguyen
*Assistant Examiner*—Luan V Van
(74) *Attorney, Agent, or Firm*—Timothy P. Evans

(57) ABSTRACT

A fixture is disclosed to more easily affix a workpiece in the proper orientation and spacing with sealed electrical interconnection within an electrochemical plating bath. The workpiece can be any planar metallic or non-metallic substrate such as a silicon wafer commonly used in LIGA or microsystem fabrication. The fixture described allows the workpiece to be submerged deep within an electrolytic cell, facing upwards, and allows easy transfer from one cell to another. The edges, backside, and electrical connections are sealed and protected from the electrolyte.

5 Claims, 13 Drawing Sheets

APPARATUS AND METHOD FOR ELECTROFORMING HIGH ASPECT RATIO MICRO-PARTS

CROSS REFERENCE TO RELATED APPLICATIONS

This application is a continuation-in-part of prior co-pending U.S. patent application Ser. No. 11/112,927 originally filed Apr. 22, 2005 entitled "ALUMINUM RESIST SUBSTRATE FOR MICROFABRICATION BY X-RAY LITHOGRAPHY AND ELECTROFORMING", which is herein incorporated by reference in its entirety.

STATEMENT OF GOVERNMENT SUPPORT

The United States Government has a paid-up license in this invention and the right in limited circumstances to require the patent owner to license others on reasonable terms as provided for by the terms of contract No. DE-AC04-94AL85000 awarded by the U.S. Department of Energy to Sandia Corporation.

BACKGROUND OF THE INVENTION

1. Field of the Invention

The present invention generally relates to methods and apparatus for holding and positioning a workpiece mold into which metal parts are to be electroformed. More particularly, the present invention relates to a system for holding one or more micromolds within an electrolytic cell with the desired orientation, spacing, and electrical interconnections such that the features evinced in the micromold are reliably reproduced through an electroforming process.

2. Related Art

The LIGA process (from the German for Lithographie, Galvonoformung und Abformung) is a method of microfabrication based on deep x-ray lithography and electrodeposition for providing devices such as MEMS (micro-electromechanical systems). This process is capable of producing small metal parts having lateral dimensions of several centimeters, overall height dimensions of a millimeter or more, and feature sizes of less than a micrometer. To make such parts, a thick x-ray resist, usually poly(methyl methacrylate) (PMMA), is bonded or cast onto a substrate to which an electrically conductive layer has been applied. The PMMA resist is then exposed to synchrotron radiation through a patterned mask. The resist is subsequently developed, yielding a patterned mold attached to the substrate whose openings extend to the conductive layer. This mold is then filled by a process of electrodeposition to form the individual metal parts, the resist is chemically removed, and the finished parts are released from the substrate. This abbreviated process is illustrated in FIG. 1.

The manufacture of MEMS devices, therefore, requires the formation of metal structures having a wide range of feature sizes by electroforming them onto an electrically conductive metal layer placed onto one surface of a suitable substrate and which is exposed after the resist is exposed and developed. Because electroplating involves making electrical contact with the substrate surface upon which the electrically conductive material is to be deposited, it is important that the electrical contact with that surface be uniform and reliable as possible. Moreover, for optimum plating efficiency it is also important to be able to securely orient and hold that substrate in a fixed position while it is immersed into a electrolytic bath in order to insure uniform deposition.

The prior art is replete with examples of devices used to hold a round workpiece for electroplating. One of the first is U.S. Pat. No. 2,938,850 to Nali which provided an elongated wire frame to which ends in a set of spaced apart hooks into which the workpiece is held.

Another is U.S. Pat. No. 3,481,858 to Fromson which uses a vacuum supply to apply suction to a bell-shaped rubber cup for holding a wafer-like disk immersed in a plating bath.

Yet another example is U.S. Pat. No. 4,696,729 to Santini describing an electrolytic cell in which one of the containment walls contains a number of openings each having a diameter the size of the workpiece wafer and a lip extending into the opening to create an open aperture with a diameter slightly smaller than the diameter of the wafer. Wafers are held in place between the interior surface of the lip and a horizontal clamp and "o" ring assembly that pushes the wafer against lip.

An example of a "nested" plate assembly is described by U.S. Pat. No. 5,135,636 and shows a plate having a shallow cylindrical depression into which a wafer is held. Electrical contact to the plating surface of the wafer is made by means of three spring loaded contact "cams".

U.S. Pat. No. 5,227,041, to Brogden, et al., teaches a dry contact electroplating structure. The structure includes a base member for immersion within an electroplating to solution. The base member has a central aperture defined by an aperture perimeter formed within the base member. A sealing ring is positioned adjacent to the aperture perimeter. The sealing ring forms a sealing connection with an object to be electroplated. A number of electrical contacts are positioned adjacent to the sealing ring. The electrical contacts form an electrical connection with one side of the object to be electroplated. A lid is positioned on the base member over one side of the central aperture. Thus, the lid protects the electrical contacts and one side of the object to be electroplated, while the other side of the object is exposed to the electroplating solution. Brogden, et al. further teach that the contacts preferably include relatively sharp tips for piercing any insulating substance which may be present on the wafer plating surface.

U.S. Pat. No. 5,228,967, to Crites, et al., teaches an electroplating system and method for electroplating wafers that includes supporting a plurality of wafers on a backing board in the electroplating tank such that one surface of each wafer is masked from the electrolytic reaction. Electrical contact is made by means of a beak-shaped pinch probe at a single point.

U.S. Pat. No. 5,312,532, to Andricacos, et al., teaches a multi-compartment electroplating system comprising a cathode-paddle-anode assembly for each compartment, wherein each of the assemblies has four supporting legs extending into the plating compartment attached to a cathode plate adapted for holding a wafer. The cathode plate further contains an aperture allowing access to the top surface of the wafer. Finally, a lifting jig is used to raise the wafer in place where it moves against an electrical contact wire on four sides around its perimeter.

U.S. Pat. No. 5,405,518, to Hsieh, et al., teaches an electrochemical etching apparatus containing a workpiece holder, which contains a first base plate and a second base plate to be joined together by screws; the first base plate having a recess on the front face thereof for receiving and retaining the workpiece, and both the first and second plates having a through hole to receive a contact electrode, which is electrically connected to a conductor wire. The assembly provides that the unintended portions of the workpiece, as well as the rear and side portions thereof, are protected from the etching fluid by first and second O-rings. Electrical contact, however, must be made from the rear of the workpiece.

U.S. Pat. No. 6,156,167, to Patton, et al., teaches an apparatus for electroplating a wafer surface that includes a cup having a central aperture defined by an inner perimeter, a compliant seal adjacent the inner perimeter, contacts adjacent the compliant seal and a cone attached to a rotatable spindle. The compliant seal forms a seal with the perimeter region of the wafer surface preventing plating solution from contaminating the wafer edge, wafer backside and the contacts. As a further measure to prevent contamination, the region behind the compliant seal is pressurized. By rotating the wafer during electroplating, bubble entrapment on the wafer surface is prevented.

However, the fixture described by Patton, et al. holds the wafer in an inverted position as do most if not all of the most recent examples of wafer holders used for electroplating. Moreover, electroplating requires immersing the wafer workpiece into the plating solution (i.e., a solution containing ions of the element being deposited). In those cases which require forming a MEMS structure by plating into a high aspect ratio mold it is necessary to orient and hold the mold in such a way as to avoid entrapping bubbles within the fine structure of the mold itself. This cannot be done easily or reliably using a device that inverts the substrate to which the mold is attached. Furthermore, when plating a plurality of MEMS structure across the surface of a large substrate, it is important to maintain close control the tolerance of the plating thickness as a percentage of the total thickness plated.

Furthermore, it will be appreciated that Brogden, et al. (U.S. Pat. No. 5,227,041), Patton, et al (U.S. Pat. No. 6,156,167), and others describe making electrical contact with a substrate (wafer) by means of one or several sharp metal tips. However, even with relatively sharp tips, one or more of the contacts may form a poor electrical connection with the wafer plating surface. This results in non-uniformity of the deposited electrically conductive layer and reduced yield since poorly plated parts must be discarded. What is needed also, therefore, is an easy and reliable method for making electrical contact to the substrate to be electroplated.

SUMMARY OF THE INVENTION

Accordingly, there is a need for an apparatus for plating into a plurality of MEMS molds fixed to a substrate, wherein air within the fine structure of the molds is removed and replaced with a fluid such as water, and placed into an electrolytic bath without introducing bubbles within the fine structure of the molds.

It is, therefore, an object of this invention to provide a simple holding means and method for preventing bubble accumulation in a LIGA mold when the mold is inserted into an electrolytic bath.

Still another object of this invention is to provide a method for sealing a substrate in order that only one surface is exposed to the electrolytic bath.

Another object of the invention is to provide a means for fixing the location of the LIGA mold within the electrolytic bath.

Yet another object of this invention is to provide a method for electrically attaching the conductive surface of the substrate to a power supply.

Again, an object of the invention is to include means for "flattening" the electric field of the electrolytic cell above the mold during electroforming and thereby provide a uniform deposition from one mold to the next across the width of the substrate surface.

A last object of the invention is to provide a means for quickly and easily establishing electrical contact with the substrate to be electroplated.

DETAILED DESCRIPTION OF EMBODIMENT OF THE INVENTION

Figure 1:
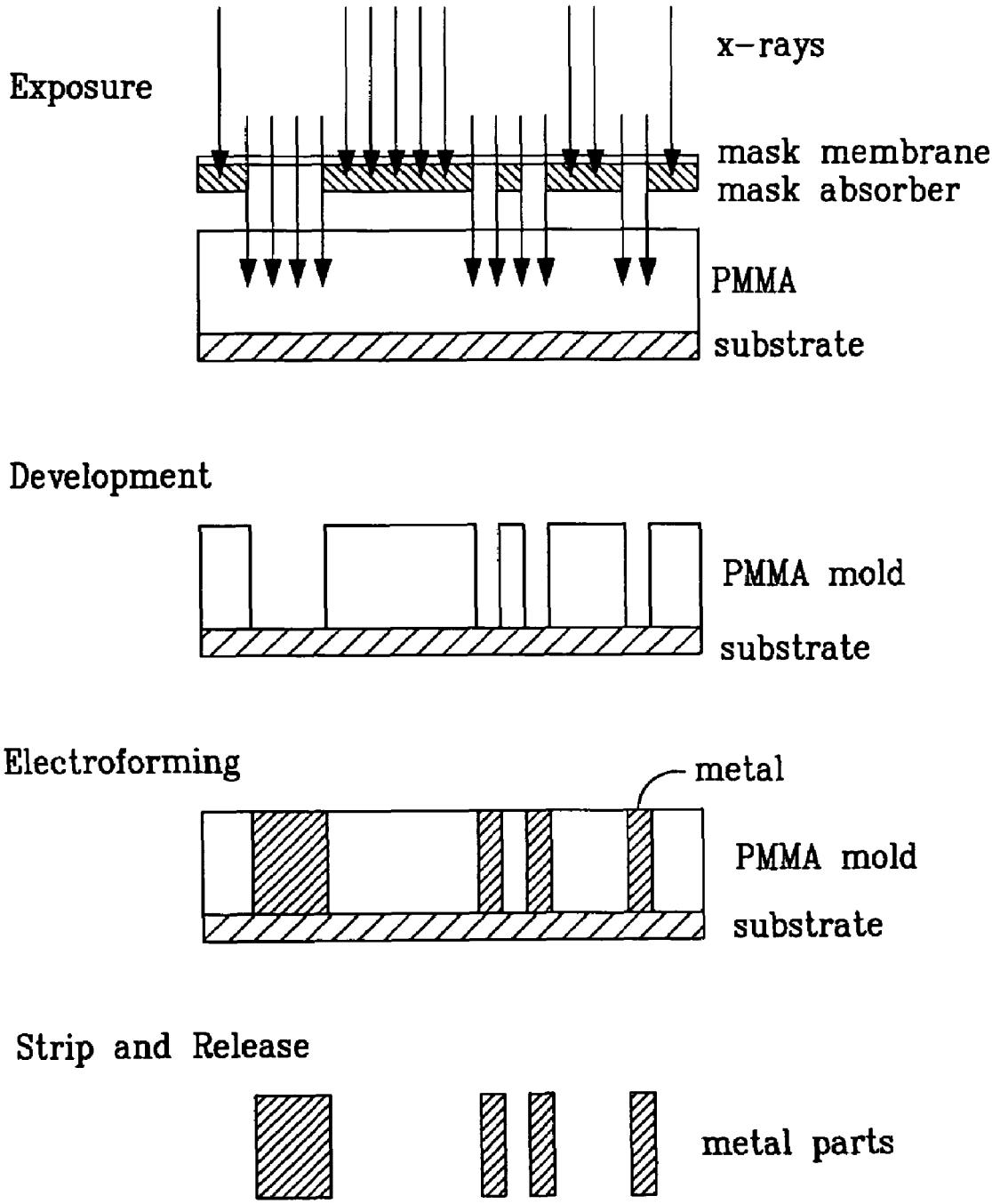
FIG. 1 Prior Art
FIG. 1 shows a schematic of the LIGA process as applied to the fabrication of free-standing metal parts wherein the top surface of the mold is planarized following electrodeposition for fabrication of metal parts.
Figure 2:
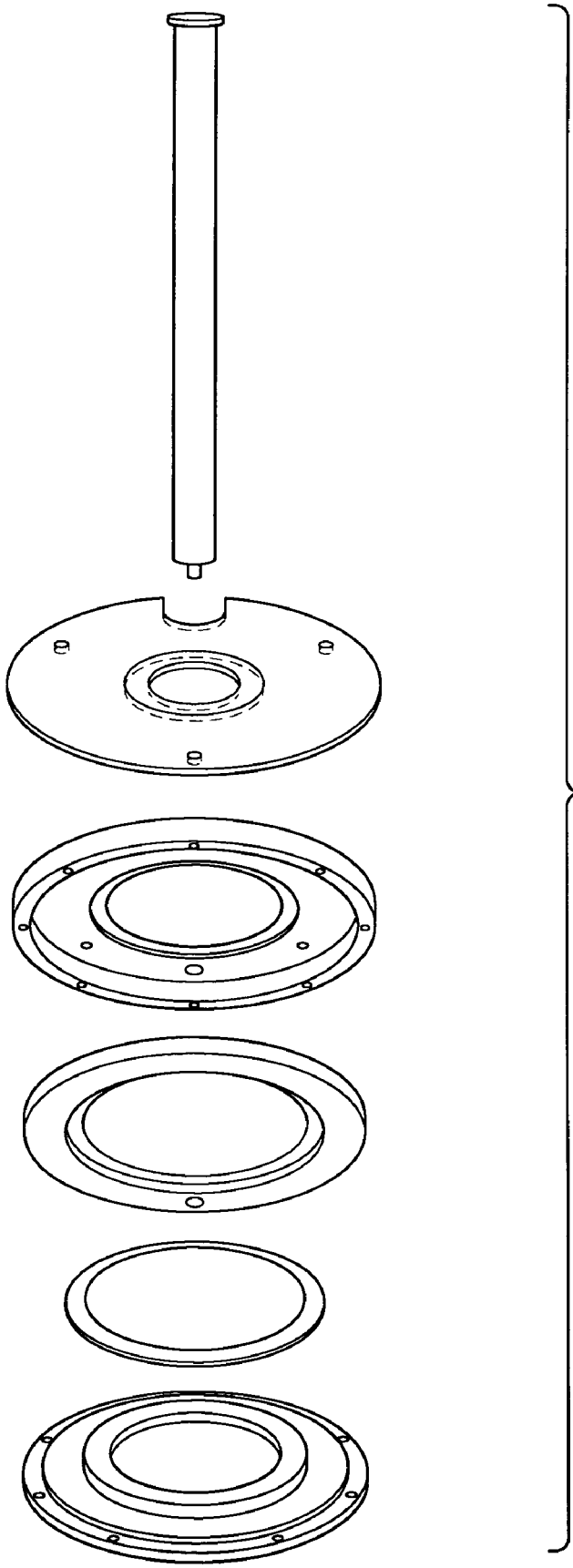
FIG. 2 shows an exploded view of the major component parts of the plating holder of the present embodiment.

The device of the present invention, therefore, is intended to allow a user to quickly and easily assemble a LIGA mold into an electroplating holder and to orient the mold to prevent bubble formation in the mold during electroforming. The device also allows a user to contact a conductive layer which is applied to the substrate before forming the LIGA mold. This layer is contacted at many points around the periphery of the substrate through the use of a contact ring designed to rest on the top surface of the substrate FIG. 2 shows an exploded view of the major parts of electroplating holder 100 for holding a substrate/mold assembly shown in FIG. 3. The device is comprised of a vertical assembly rod, an optional plating shield, an assembly cover, a metal contact ring, a substrate/mold assembly, and a substrate support plate.

Figure 3:
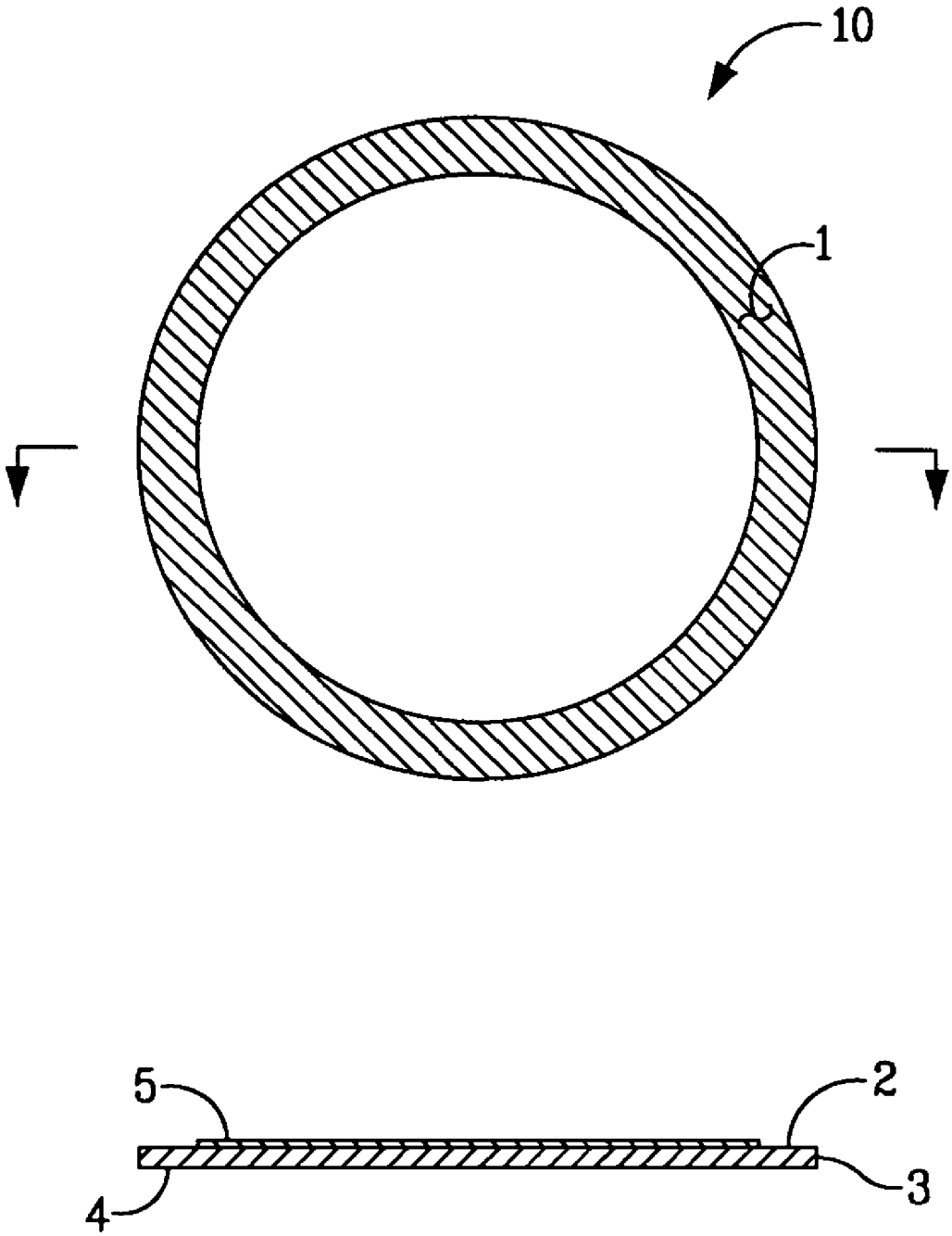
FIG. 3 shows a substrate/mold assembly 10 of the present embodiment comprising a substrate wafer coated with a conductive metal layer covering a top surface, and a PMMA layer mounted on and fixed to a the top surface of the wafer.

As shown in FIG. 3, substrate/mold assembly 10 is comprised of a substrate wafer 3 such as for instance silicon having a conductive metal layer 1 deposited onto a top surface 2, while backside surface 4 remains uncoated. PMMA layer 5 is then disposed onto metal layer 1 and fixed thereto an adhesive and once lithographically processed as described below forms a plating mold having recesses (not shown) open to conductive layer 1.

Figure 4:
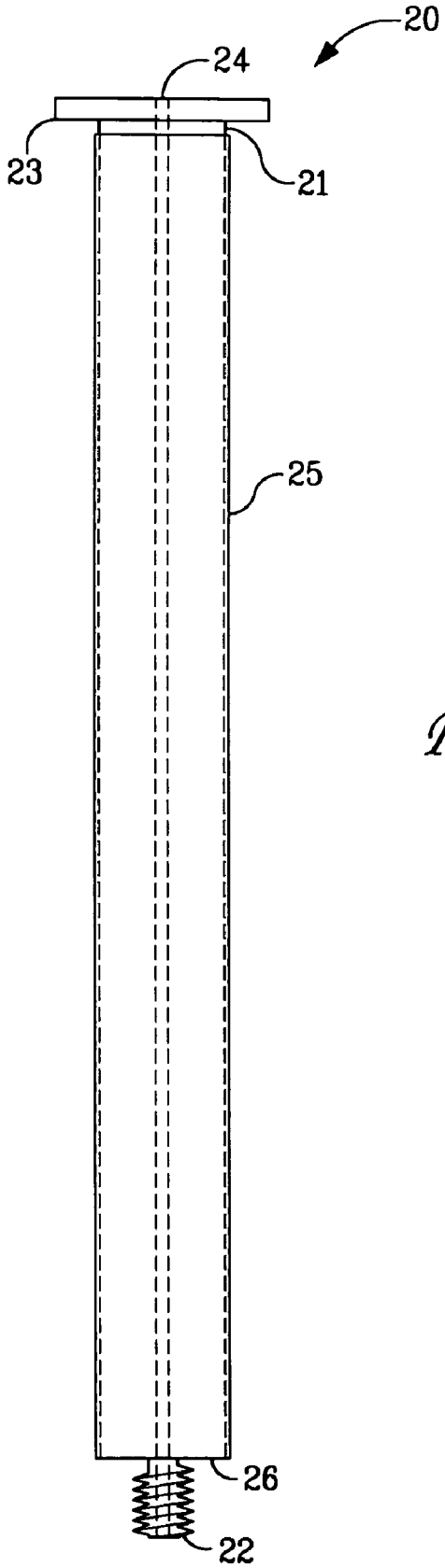
FIG. 4 shows a plan and cross-sectional view of vertical assembly rod 20 of the present embodiment.

As shown in FIG. 4 vertical assembly rod 20 further includes a long metal rod 21, typically an austenitic steel, having a short, threaded stem 22 for engaging a threaded hole, a cylindrical cap 23 opposite the treaded stem, a central interior opening 24 running the length of the rod, cap and threaded stem, and a shrink-fit insulating sleeve 25 extending over the length of the outside cylindrical surface of rod 21.

Figure 5:
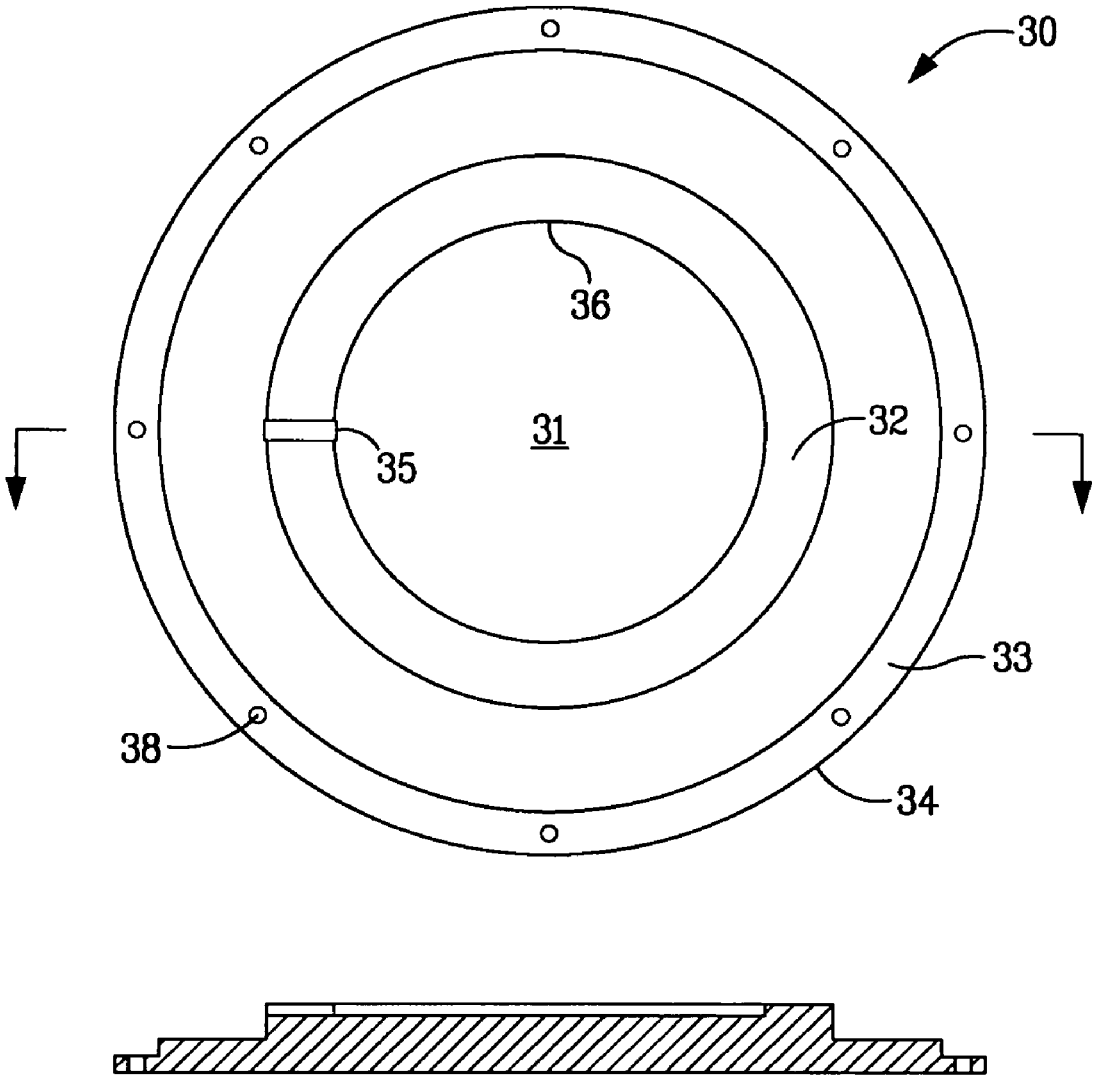
FIG. 5 shows a plan and cross-sectional view of support plate 30 of the present embodiment.

FIG. 5 shows support plate 30 comprises a machinable polymer such as polyether ether ketone, fabricated to provide a raised central post 31, a ring-shaped pad 32 integral with on post 31, and a narrow recessed flange 33 running along the circumference of outside edge 34 of plate 30 to which gasket 60 (not shown) is fixed. Further, plate 30 includes vent 35, comprising a shallow slot through pad 32. Finally, support plate 30 includes a number of clearance holes 38 through flange 33 and spaced equidistantly around the circumference of support plate 30 through which assembly screws are passed.

Figure 6:
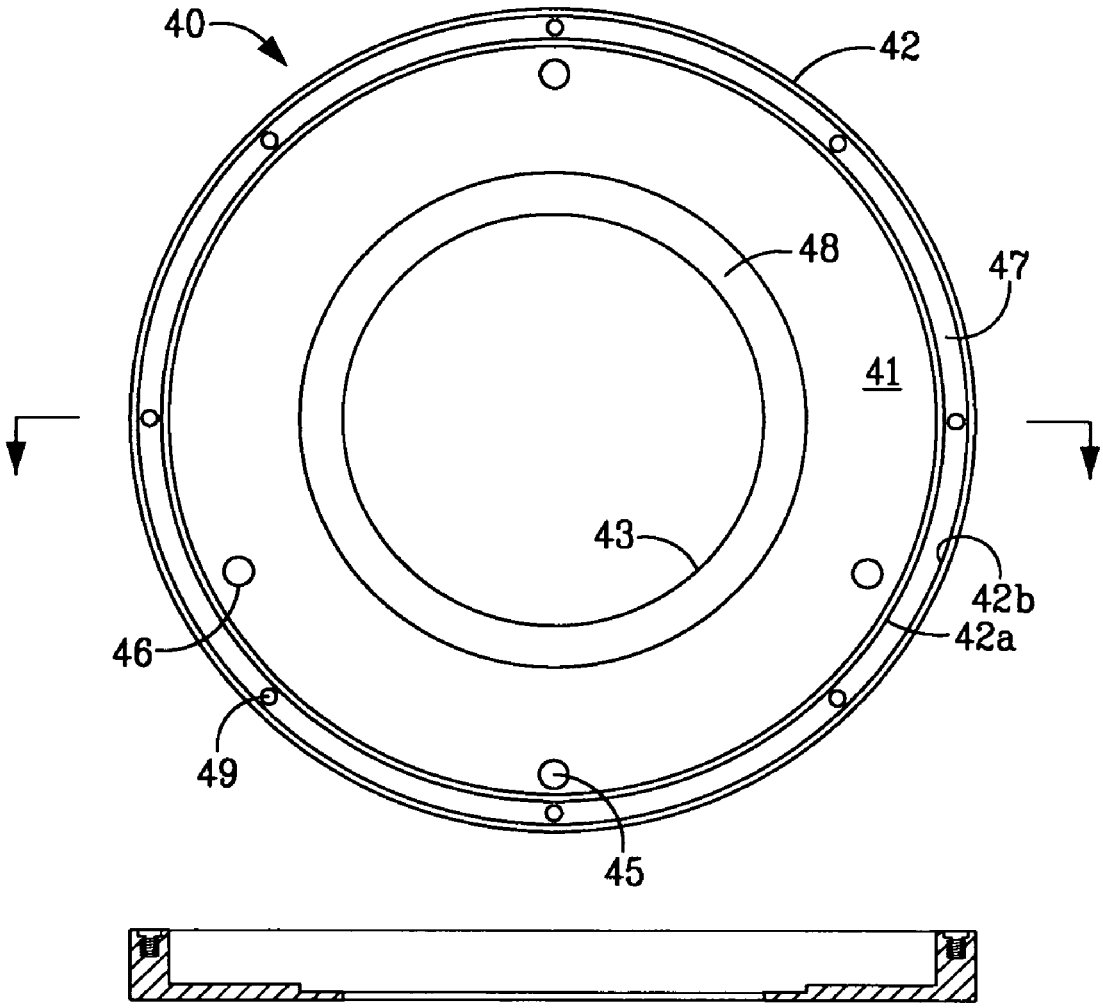
FIG. 6 shows a plan and cross-sectional view of cover 40 of the present embodiment.

FIG. 6 shows assembly cover 40 as comprising a thick polymer disc, again comprising polyether ether ketone, fabricated to provide a deep central recess 41 surrounded by a relatively thick circumferential wall 42, and a large opening 43 coaxial with recess 41. Because cover 40 is intended to engage and cover support plate 30 when holder 100 is assembled, the depth of recess 41 is chosen to provide adequate clearance for raised post 31, substrate/mold assembly 10 which rests on post 31, and contact ring 50 which will rest on top of substrate/mold assembly 10. Moreover, the diameter of recess 41 is chosen to closely receive contact ring 50. Cover 40 further includes a clearance hole 45 through which threaded stem 22 passes; several additional clearance holes 46, through which individual members of shield stand-off means 80 pass; a wide square groove 47 cut into the top surface of wall 42 to provide inside and outside lip extensions 42*a* and 42*b* for engaging gasket 60 (not shown); and a shallow narrow recessed flange 48 along the interior edge of opening 43 to which gasket 61 (not shown) is fixed. In addition, square groove 47 also includes a number of threaded assembly holes 49 spaced equidistantly around the circumference of the groove to provide a means for assembling cover 40 to support plate 30.

Figure 7:
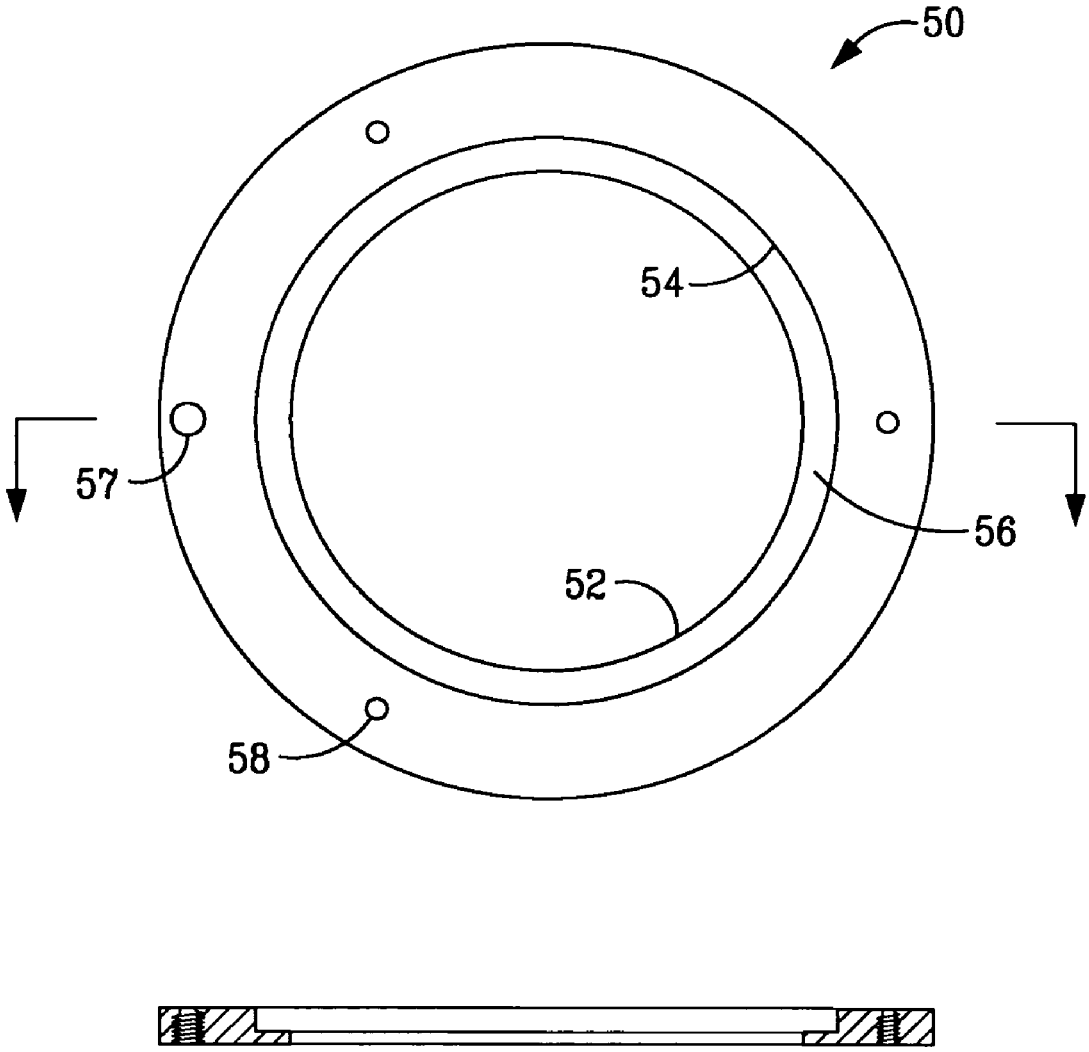
FIG. 7 shows a plan and cross-sectional view of contact ring 50 of the present embodiment.

FIG. 7 shows metal contact ring 50 comprising a wide, flat ring, again typically fabricated from an austenitic steel, and having a large central opening 52. Moreover, the thickness of contact ring 50 is undercut adjacent to opening 52 to provide an annular recessed region 54 that results in an interior flange portion 56. It will be appreciated that recessed region 54 is sized to provide adequate clearance for the outside dimensions of substrate/mold assembly 10 where conductive (topside) surface 2 can come into contact with flange portion 56. In additional, contact ring 50 further includes a single threaded hole 57 to receive threaded stem 22 and several additional threaded holes 58 to receive individual members of shield stand-off means 80.

Figure 8A:
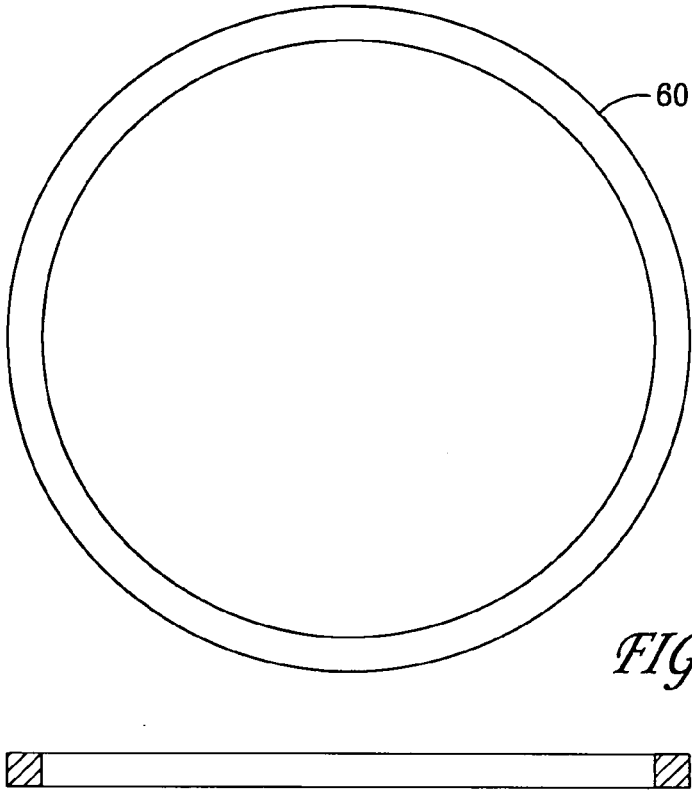
FIGS. 8A-8C show a plan and cross-sectional view of silicon rubber gaskets 60, 61, and 62 of the present embodiment.
Figure 8B:
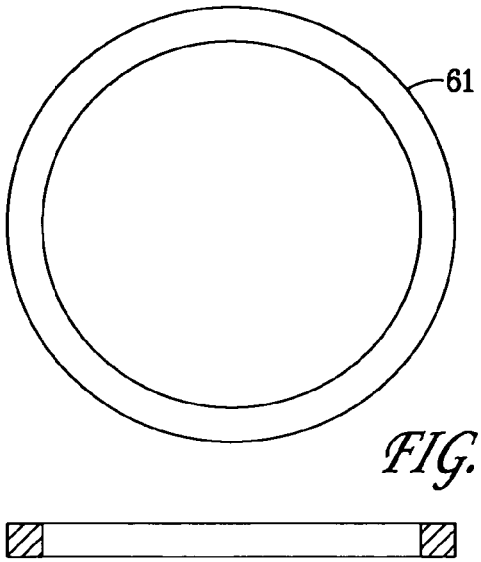
Figure 8C:
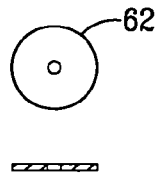

FIGS. 8A and 8B show gaskets 60 and 61 comprising annular rings of a lightweight silicone rubber open cell foam. FIG. 8C shows gasket 62 a flat sheet of RTV silicone rubber.

Figure 9:
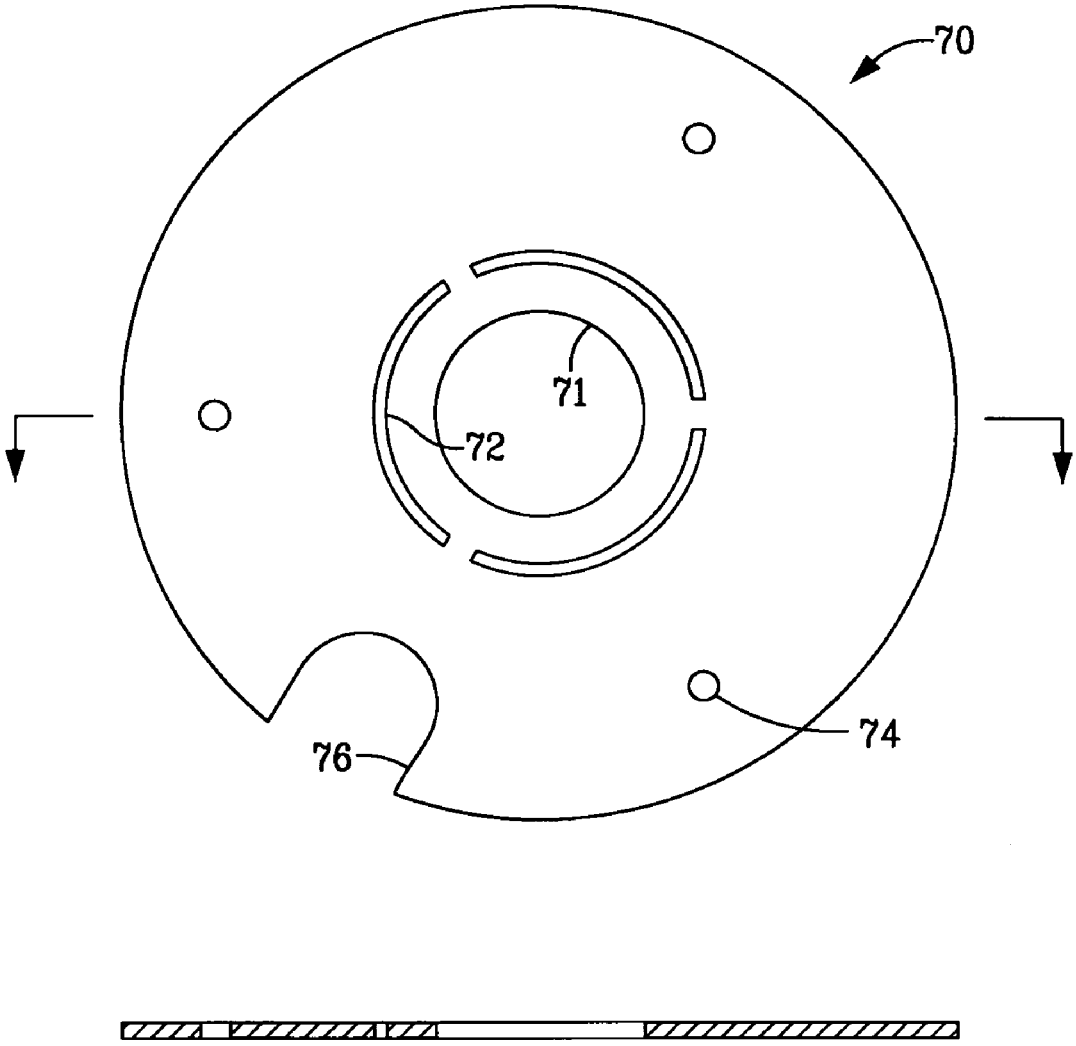
FIG. 9 shows a plan and cross-sectional view of optional shield 70 of the present embodiment.

FIG. 9 shows an optional plating shield 70, similar to the embodiment described in commonly owned U.S. Pat. No. 6,802,950 "Apparatus and Method for Controlling Plating Uniformity," (herein incorporated by reference), comprises a thin disc of a non-conductive material that is resistant to the acid bath typically used in nickel electroplating processes. Typical materials might include for example PMMA, polyethylene, polypropylene, fluoro-polymers (e.g., TEFLON®), or polyvinylidene fluoride. Shield 70 further comprises several openings chosen to selectively alter the electric field between the anode and a plating surface and thereby control the uniformity of plating deposition rate across the exposed PMMA layer 5 of substrate/mold assembly 10. This is important since the PMMA layer is lithographically patterned and "developed" to provide a LIGA plating mold. Central opening 71 is surrounded by a second narrow annular opening 72 and is scaled to about 50% of the exposed "wafer" radius which for this purpose is taken to be the radius of the exposed plating mold. Annular opening 72 is scaled such that its inner and outer radii are about 67% and 72% of the radius of the exposed plating mold, respectively. Shield 70 further includes several equidistantly spaced clearance holes 74 located on a diameter near the outside edge of the shield to receive individual members of shield stand-off means 80, and wide semicircular slot 76 to provide access for assembly rod 20. Shield 70 is held at a fixed distance above the surface of the plating mold by stand-off means 80 which might comprise, for instance several sets of threaded spacers set at a fixed distance above the top surface of the plating mold equal to about 30% of the exposed mold radius, a length of threaded plastic rod to pass through the threaded spacers, into clearance holes 46 through cover 40, and into threaded holes 58 on contact ring 50. A plastic wing nut would then secure optional plating shield 70 firmly in place.

Figure 10:
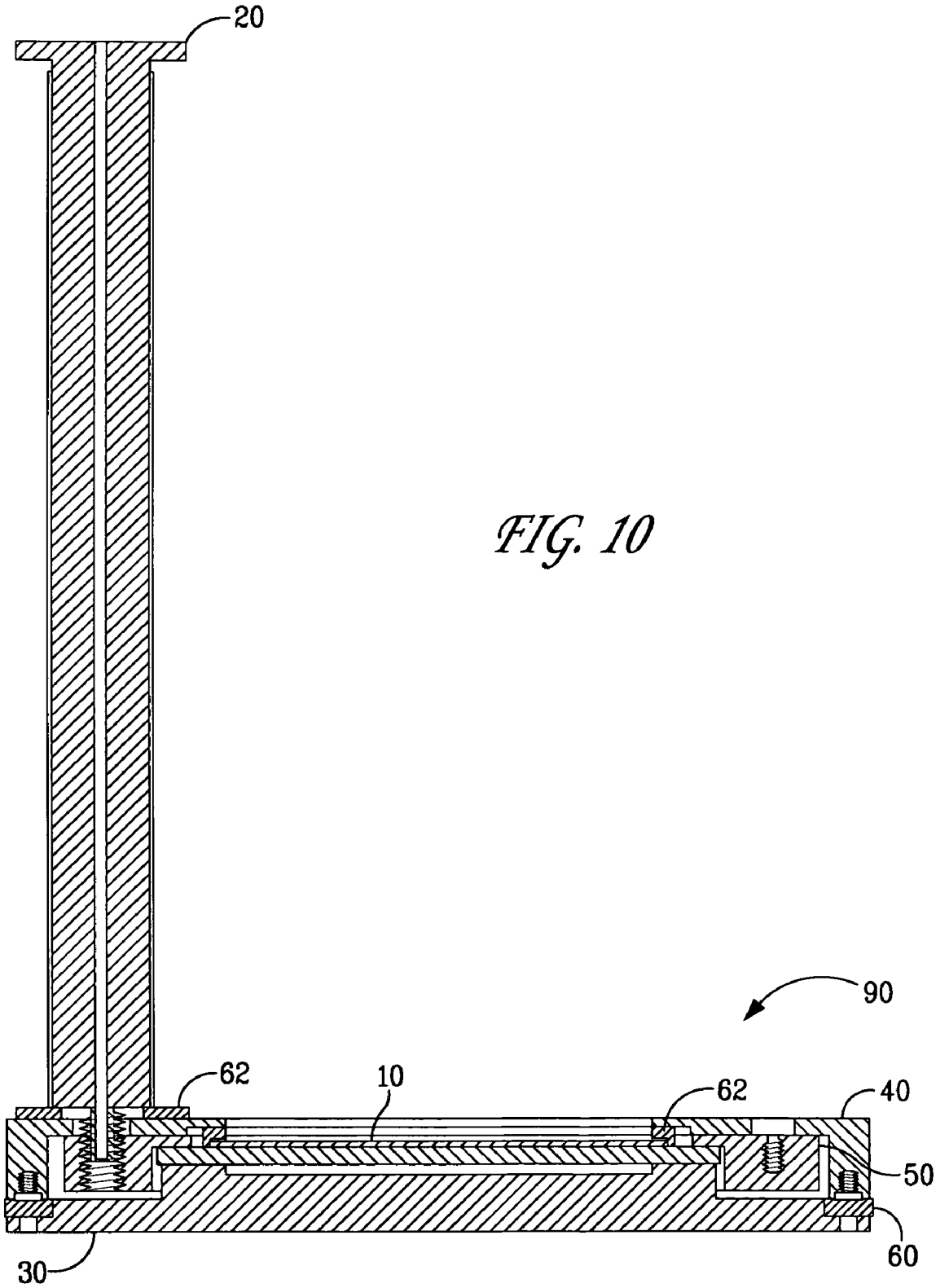
FIG. 10 shows a detailed cross-sectional view of the wafer holder of the present embodiment.

In order to assemble electroplating holder 100 and to maintain a leak-tight seal within the interior of the electroplating holder once it is assembled and protect the substrate edges, backside, and electrical connections from the electrolyte plating solution, three gaskets are provided. Gasket rings 60 and 61 are prepared by die-cutting each ring from a stock sheet of 0.25 inch thick low density silicone foam obtained from McMaster-Carr (Elmhurst, Ill.). A third gasket 62 is cut from an 0.062" thick sheet of RTV silicone rubber stock. Gasket 60 is fixed to flange 33 and gasket 61 to flange 48 using a contact adhesive or some other suitable adhesion agent. As shown in cross-section in FIG. 10 the backside surface 4 of substrate/mold assembly 10 is roughly centered on ring-shaped pad 32 with metal contact ring 50 resting on substrate 3 so that recessed region 54 captures the outside edge of the substrate and so that flange portion 56 rests directly on substrate topside surface 2 making contact with conductive layer 1 applied to that surface. The thickness of contact ring 50 is designed to be less than the combined heights of the substrate and contact ring. This allows assembly cover 40 to be disposed over the assembled support plate and contact ring subassembly to form cover/ring/plate subassembly 90: a kind of "clam shell" pressing contact ring 50 onto the outside edge of substrate topside surface 2. The two parts are fastened together by a placing an assembly screw through each of several support plate clearance holes 38 and screwing it into each of the adjacent threaded holes 49 in cover 40. It will be appreciated that this design has the added advantage of centering both substrate/mold assembly 10 and contact ring 50; it also keeps contact ring 50 in direct contact with conductive layer 1 once cover 40 and plate 30 are fastened together.

Figure 11:
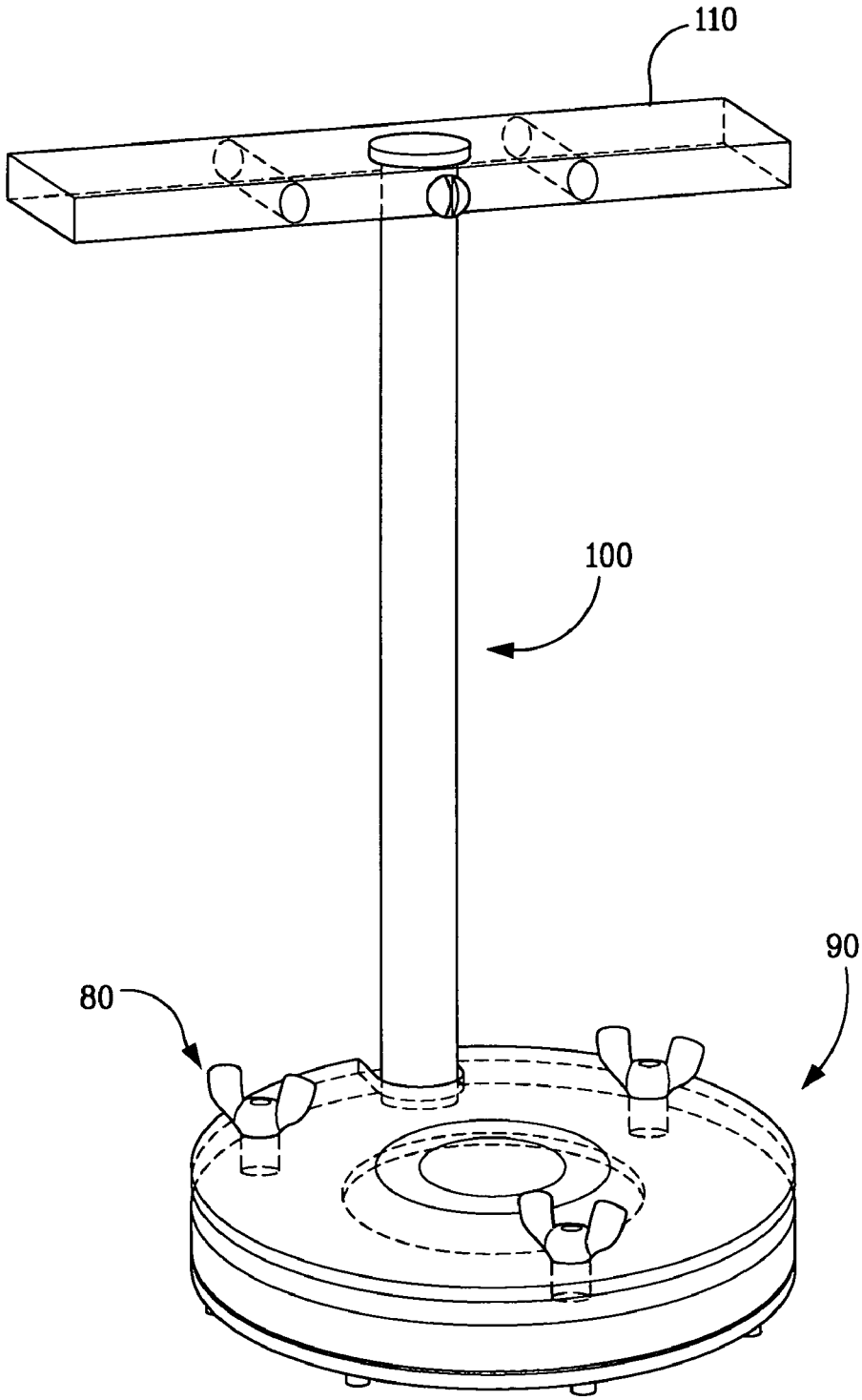
FIG. 11 shows an isometric view of the assembled wafer holder of the present embodiment.

Assembled electroplating holder 100 is shown completed in FIG. 11. Holder 100 includes optional handle cross member 110 mounted over assembly rod 20 and then attaching assembly rod 20 to the cover/ring/plate subassembly 90. The interior of the subassembly 90 is sealed by placing gasket 62 over on the threaded stem 22 so that as the stem is then passed through cover clearance hole 45 and screwed into threaded hole 57 in contact ring 50 gasket 62 is pressed between cover 40 and the bottom surface 26 of assembly rod 20. Lastly, optional plating shield 70 may be attached to the top surface of cover 40 using stand-off means 80 and by attaching assembly rod 20 to the plate and cover clam-shell assembly.

It will be appreciated that once the various parts of the electroplating holder are assembled, the interior portions of the holder assembly may be evacuated, including the region beneath substrate/mold assembly 10, through central interior opening 24 in rod assembly 20. Furthermore, because both assembly rod 20 and contact ring 50 are metal parts, electrical contact can be made with conductive layer 1 simply by making electrical contact with assembly rod 20.

Subsequent electrodeposition onto the conductive surface exposed through the LIGA plating mold is performed as follows. In a vacuum vessel the assembled electroplating holder 100 and a quantity of deionized water are pumped for about an hour to a pressure of about 10 kPA (~27 in. Hg vacuum). Interior spaces of assembled holder are evacuated through central opening 24 and vent 35. Substrate holder 100 is then placed into the degassed water while still under vacuum, thereby flooding the LIGA plating mold such that cavities in the plating mold are filled with water under the vacuum. The pressure in the vacuum vessel is then returned to ambient conditions. This procedure ensures that all of the plating mold cavities are completely filled, without the possibility of trapped bubbles even in very small cavities of high aspect ratio.

The electroplating holder 100 and substrate/mold assembly 10 are then transferred immediately into an electrolyte bath and allowed to soak without applied current for a period sufficient to ensure full displacement of the water with electrolyte. The minimum soak time is given approximately by $t \approx 0.8h^2/D$ where h is the resist thickness in meters and $D \approx 10^{-9}$ $m^2/s$ is a diffusivity characteristic of metal ions in water. This yields about 15 minutes for a resist thickness of 1 mm and about 5 minutes for a thickness of 0.5 mm. A soak time of 30 minutes is therefore suitable for most molds used for LIGA since mold height of greater than 1 mm are not commonly used. An alternative to this fill-and-soak method is to fill the mold cavities directly with an electrolyte using the vacuum backfill process described above. In this case a soak period is not required.

After this soak period, a current is applied gradually, increasing from 0.1 $mA/cm^2$ to about 6 $mA/cm^2$ in about one minute. The current is then held at 6 $mA/cm^2$ for a period sufficient to produce a copper deposit having a thickness of several micrometers. This copper layer acts as a sacrificial layer for part release following electroplating. The electrolyte used for this process is copper pyrophosphate maintained typically at 50° C. and a pH of 8.5. The bath is vigorously agitated and filtered continuously. The anode used in these experiments comprised a titanium basket filled with high-phosphorous copper pellets (obtained from Sherwood Metals).

After depositing the sacrificial layer of copper, substrate/mold assembly 10 is transferred to a second quantity of degassed, deionized water for 5 minutes and then to a third quantity of degassed, deionized water that is pH-adjusted using a suitable acid such as sulfuric or sulfamic. The pH of this third quantity of water is matched to the pH of the final bath used in forming the metal structures, e.g., pH 3.5 for most nickel electrolytes. This ensures that the high pH water or any copper pyrophosphate remaining in cavities does not lead to the formation of precipitates inside the cavities when the resist is immersed in the final bath. Again, the duration of this pH-adjusted soak must be sufficient to ensure full displacement of any residual water or pyrophosphate; a period of 30 minutes is usually adequate. Substrate/mold assembly 10 is then ready for electroforming metal structures in the resist cavities using any desired electrolyte bath.

EXAMPLE

Ni/Mn Spring

In order to demonstrate the utility of the present embodiment a mold was prepared for providing a number of miniature nickel-manganese springs. A 100 mm silicon wafer was coated with a metal conductive layer comprising a 70 nm thick titanium layer on a 400 nm thick copper layer and another 70 nm titanium layer over the copper layer as described in commonly-owned U.S. Pat. No. 6,517,665, herein incorporated by reference. The outer titanium layer is then chemically stripped and a 1 mm thick×82 mm diameter piece PMMA mold 5 is bonded onto substrate 3 over the conductive layer using a PMMA-based glue developed at Forschungszentrum Karlsruhe (FZK). The adhesive consisted of 10 g of 15% by weight PMMA (950 kg/mol) in MMA, 0.1 g N,N-dimethyl aniline, 0.1 g 3-(trimethoxysilyl) propyl methacrylate (MEMO), and 0.1 g benzoyl peroxide. This was degassed under a vacuum of 22 mmHg for a few minutes before application, and the bond interface was loaded to 450 kPa (65 psi) with a press and glass platens for a minimum of four hours.

Figure 12A:
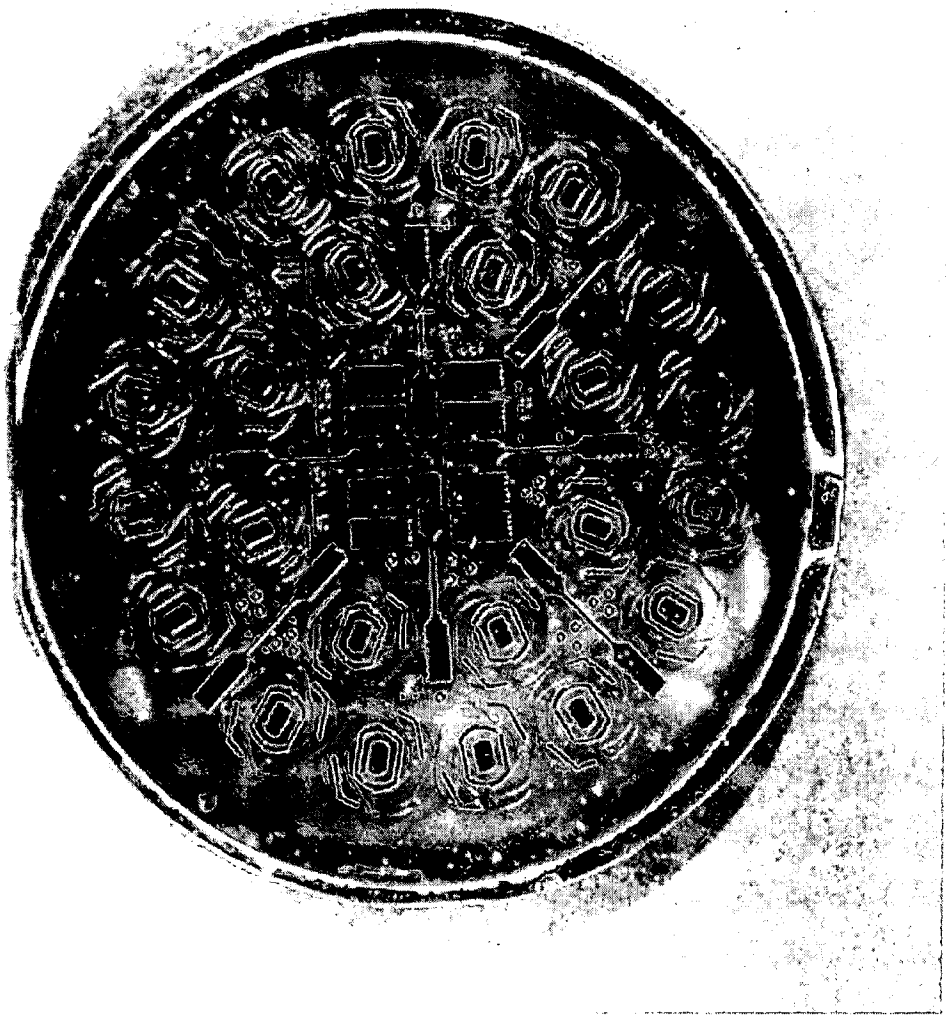
FIG. 12A shows an image of a LIGA mold mounted on a silicon wafer where the mold has been prepared to produce 24 miniature Ni—Mn LIGA spring.

Substrate/mold assembly 10 was then exposed using the Lawrence Berkeley National Laboratory Advanced Light Source ("ALS") operating at 1.9 GeV in order to lithographically render a pattern into PMMA layer 5 through its thickness with high energy X-rays. The substrate/mold assembly 10 thus exposed were then developed by a process similar to that disclosed in commonly-owned U.S. Pat. No. 6,517,665 to remove those portions of the PMMA layer that had been exposed to X-ray radiation thereby providing a structure comprising one or more cavities in the PMMA layer open to underlying conductive metal layer 1 that can be used as a plating mold. An example of such a substrate/mold assembly prepared in this manner is shown in FIG. 12A.

Figure 12B:
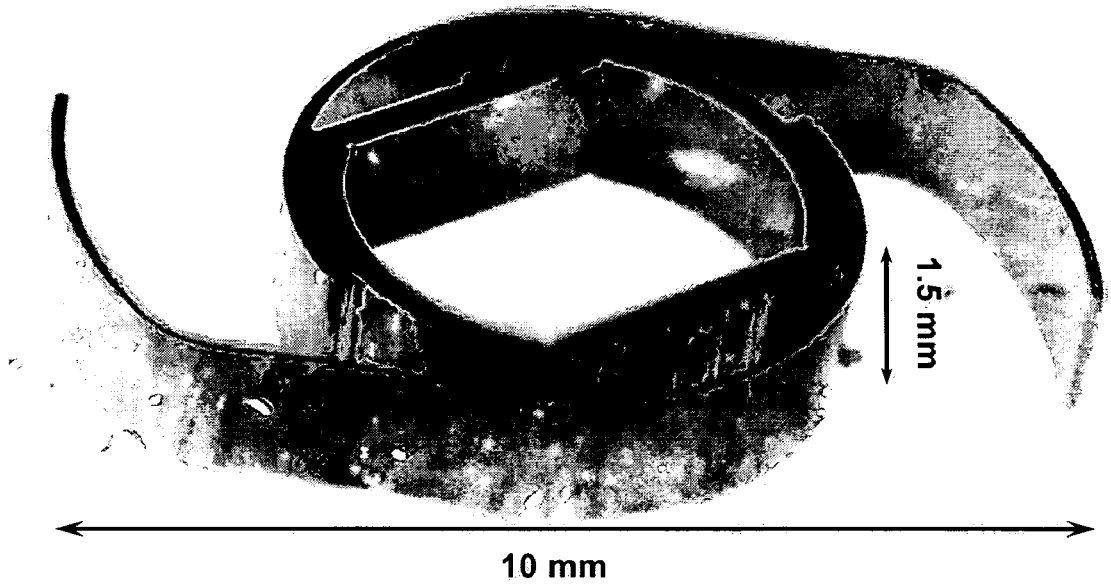
FIG. 12B shows an image of one of a miniature Ni—Mn LIGA spring.

This part was then assembled into electroplating holder 100 and the entire assembly degassed and immersed in a quantity of similarly degassed, deionized water as described above. Again as described above, the electroplating holder and plating mold are returned to ambient pressure, immediately sent through the preliminary soak cycle, and then transferred into a nickel sulfamate plating solution additionally containing 10 g/L manganese. Again, the parts were left to soak for about 30 minutes to allow the plating solution to diffuse into the mold cavities and displace the fill water. The parts were then formed by electrodeposition pulse plating as described in commonly-owned U.S. Pat. No. 6,902,827, herein incorporated by reference. A representative part is shown in FIG. 12B. The overall height of these parts formed in this way is 1.5 mm and the nominal wall thicknesses of the spring "arms" is 0.15 mm.

Finally, to the extent necessary to understand or complete the disclosure of the present invention, all publications, patents, and patent applications mentioned herein are expressly incorporated by reference therein to the same extent as though each were individually so incorporated.

Having thus described exemplary embodiments of the present invention, it should be noted by those skilled in the art that the disclosures herein are exemplary only and that various other alternatives, adaptations, and modifications may be made within the scope of the present invention. Accordingly, the present invention is not limited to the specific embodiments as illustrated herein, but is only limited by the following claims.

What is claimed is:

1. An apparatus for electroforming a MEMS part, comprising:

a plate having a raised central platform;

a first annular gasket fixed along an outer perimeter of the plate;

a workpiece mounted on the raised central platform, the workpiece comprising a substrate having a top surface coated with a conductive metal layer, and plating mold fixed to the top surface, wherein regions within the plating mold are open to the conductive metal layer;

a flat metal ring having an outer diameter, a central opening having inner diameter, a recessed surface having a third diameter between the inner and the outer diameters, the recess surface for engaging and resting on a portion of the substrate top surface proximal to an outside edge of the substrate, and means for receiving a means for physically and electrically engaging the metal ring;

a cover having an outer wall, a recessed interior space sufficient for receiving the platform, the workpiece and the metal ring, a central opening having a second diameter sufficient to provide clearance for the plating mold, and a smaller second opening adjacent to the outer wall to provide access for the means for receiving;

a second annular gasket fixed along an interior perimeter of the cover second diameter;

means for fastening the cover to the plate to form a plating fixture subassembly, wherein the means for fastening compresses the first annular gasket between the plate outer perimeter and the cover wall and the second annular gasket between the cover interior perimeter and a portion of the substrate top surface, and bringing the metal ring into compressive contact with the substrate conductive metal layer; and a metal tube comprising a metal fastening means, wherein the fastening means is inserted through the cover second opening in order to physically and electrically engage the receiving means and thereby place the metal tube, the metal contact ring, and the conductive metal layer in electrical communication with each other, and wherein the metal tube forms a handle to hold the plating fixture subassembly and the plating mold upright.

2. The apparatus of claim 1, further including a plating shield comprising a thin disc having several openings disposed about a common central axis chosen to selectively alter the electric field over the plating mold, wherein the plating shield is disposed at a fixed distance above the plating mold.

3. The apparatus of claim 1, wherein the plate and the cover comprise a machinable polymer.

4. The apparatus of claim 3, wherein the machinable polymer is polyether ether ketone (PEEK).

5. The apparatus of claim 1, wherein conductive metal layer comprises a first titanium layer, a copper layer over the first titanium layer, and a second titanium layer over the copper layer, where the second titanium layer is removed before forming the plating mold.

* * * * *